United States Patent [19]

Kilmer et al.

[11] Patent Number: 4,708,213

[45] Date of Patent: Nov. 24, 1987

[54] HYDRAULIC CORE CUTTING MOTOR

[76] Inventors: Lauren G. Kilmer, 1927 E. 35th Pl., Tulsa, Okla. 74105; John W. Carter, Jr., 2556 S. Oswego, Tulsa, Okla. 74114

[21] Appl. No.: 866,865

[22] Filed: May 22, 1986

[51] Int. Cl.[4] ..... F21B 49/02; F04C 2/39

[52] U.S. Cl. ..... 175/78; 175/58; 418/268

[58] Field of Search ..... 175/77, 78, 52, 58, 175/61, 20, 26, 405, 107; 418/261, 265, 268

[56] References Cited

U.S. PATENT DOCUMENTS

| | | | |
|---|---|---|---|
| 2,312,961 | 3/1943 | Cowherd | 418/265 X |
| 2,380,819 | 7/1945 | Allbaugh | 418/265 X |
| 4,354,558 | 10/1982 | Jageler et al. | 175/45 |
| 4,354,809 | 10/1982 | Sundberg | 418/268 |
| 4,355,965 | 10/1982 | Lowther | 418/268 X |

FOREIGN PATENT DOCUMENTS

| | | | |
|---|---|---|---|
| 56603 | 5/1936 | Norway | 418/265 |
| WO81/00018 | 1/1981 | PCT Int'l Appl. | 175/78 |
| 26529 | 11/1907 | United Kingdom | 418/265 |

*Primary Examiner*—Stephen J. Novosad
*Assistant Examiner*—David J. Bagnell
*Attorney, Agent, or Firm*—Head & Johnson

[57] ABSTRACT

An improved hydraulic motor for downhole oil and gas wells to drive a sidewall core cutting apparatus comprising; a motor housing having a fluid inlet channel and a fluid outlet channel directed essentially parallel to each other and tangentially intersecting a rotor cavity with the motor housing containing an eccentrically positioned rotor with radially movable vanes within the rotor in a manner such that the fluid flow enters the cavity essentially tangentially and flows around the rotor and exits tangentially on the other side of the cavity. Such a hydraulic motor exhibits significant improvement in torque and power output at a given hydraulic power input when compared to previous hydraulic motors employed in such applications.

1 Claim, 8 Drawing Figures

HYDRAULIC CORE CUTTING MOTOR

BACKGROUND OF THE INVENTION

1. Field of the Invention:

This invention relates to an improved apparatus for obtaining core samples of subterranean formations. More specifically, the invention relates to an improved hydraulic motor useful for drilling core cuttings from the sidewall of a drill hole or the like.

2. Description of the Prior Art:

In U.S. Pat. No. 4,354,558, an apparatus and method for drilling into the sidewall of a drill hole is disclosed and claimed. This apparatus was developed and is commercially used to obtain true samples of subterranean formations and for recovering portions of their contained fluids. Formation samples removed from downhole strata by such techniques and apparatus are useful in evaluating the geological, mineralogical and physical characteristics of the formation of interest.

As described in this patent, the sidewall coring tool is contained within a suitable housing which can be lowered, for example, on a standard 7 conductor wireline logging cable through a drill hole to a formation of interest as detected by a gamma ray logging device connected to the housing. The apparatus is then suspended at the formation of interest and by signal from a control panel, a hydraulic means is activated to wedge the apparatus within the drill hole. A hydraulic motor with a core cutting head attached thereto through a core retaining barrel is activated at the control panel for rotating the cutting head. By separate signal from the control panel, a hydraulic means is activated to move the cutting head into cutting engagement with the sidewall of the drill hole. Upon completion of cutting the core, the core retaining barrel and cutting head are deflected to break the core from the formation. the core retaining barrel containing the core is then retracted to within the housing, and the housing is removed from the drill hole. Separate hydraulic systems are provided for operating the hydraulic motor and for operating the hydraulic means. Electricity for operating the hydraulic system is provided through six of the conductors of the wireline logging cable and the seventh conductor is used for control and monitoring. In this manner, highly useful, true specimens of the formation rock including endogenous fluids can be retrieved and subsequently analyzed.

Although the apparatus and method disclosed in U.S. Pat. No. 4,354,558 has proved to be commercially successful, problems still exist with respect to providing and maintaining a reliable and powerful compact hydraulic motor in such a confined hostile environment associated with downhole oil and gas well applications. The present invention is viewed as being a specific improvement in the hydraulic motor of the sidewall coring tool described in U.S. Pat. No. 4,354,558.

SUMMARY OF THE INVENTION

The present invention provides an improved hydraulic motor to be employed in conjunction with a downhole sidewall coring tool. The improved motor when employed in a sidewall core cutting apparatus has been found to reliably produce considerably greater mechanical torque and mechanical power output at a given hydraulic power input when compared to hydraulic motors previously employed in such applications.

Thus, the present invention provides in an apparatus for drilling core cutting from the sidewall of a drill hole wherein the apparatus comprises an elongated housing with a hydraulic operated back-up shoe mounted within the housing for wedging the housing at a selected location in the drill hole and a hydraulic motor with a drilling bit connected thereto for rotation by the hydraulic motor and hydraulic means mounted within the housing and connected to the hydraulic motor for moving the bit into drilling engagement with the sidewall of the drill hole, the specific improvement comprising:

(a) a hydraulic motor housing member containing a rotor cavity adapted to eccentrically receive a rotor means therein and further adapted to drive a rotor means by virtue of fluid flow, wherein the hydraulic motor housing member further comprises:

(i) a first fluid channel passing from the outside of the hydraulic motor housing member to the rotor cavity in a substantially tangential relationship to the rotor cavity and terminating at a first position of intersection with the rotor cavity as a first fluid port, and wherein the direction of approach of the first fluid channel relative to the rotor cavity is substantially parallel to the eccentricity and is in the relative direction from axis of rotation of the rotor means towards the center of the rotor cavity, (ii) a second fluid channel passing from the outside of the hydraulic motor housing member to the rotor cavity in a substantially parallel relationship with the first fluid channel and in a substantially tangential relationship to the rotor cavity and terminating at a second position of intersection with the rotor cavity as a second fluid port on the side of the rotor cavity substantially opposite to the first fluid port, and wherein the direction of approach of the second fluid channel relative to the rotor cavity is substantially parallel to the eccentricity and is in the relative direction from axis of rotation of the rotor means towards the center of the rotor cavity, and (iii) a pair of recesses circumferentially located on a portion of the inner periphery of the rotor cavity nearest the first and second fluid ports, wherein one of the recesses intersects the first fluid port only and the other of the recesses intersects the second fluid port only and each extends circumferentially on either side of the fluid ports but do not extend substantially along those portions of the inner periphery of the rotor cavity nearest to and furthest from the axis of rotation of the rotor means, such that fluid entering the first fluid channel is directed circumferentially, in the tangential direction of approach, around the rotor cavity to the far side of an eccentrically positioned rotor means and then exits the second fluid channel;

(b) a rotor means adapted to be received circumferentially within the rotor cavity of the hydraulic motor housing and be driven by fluid entering the first fluid channel and exiting the second fluid channel, wherein the rotor means further comprises a plurality of substantially, radially oriented openings adapted to receive a radially movable vane means therein and wherein each of the plurality of substantially, radially oriented openings have at least one fluid conduit in fluid communication with the innermost portion of the substantially, radially oriented openings and adapted to establish fluid communication with the pair of recesses circumferentially located on a portion of the inner periphery of the rotor cavity during rotation of the rotor means and wherein the fluid conduit is positioned in a manner such as to establish fluid communication behind a radially movable vane means occupying the substantially, radially oriented opening and the pair of recesses by directing relatively high pressure fluid flow into the opening and behind the vane means from the recess that intersects the first fluid port during outward radial movement of the vane means and by directing fluid flow from the opening and behind the vane means to a relatively low pressure fluid in the recess that intersects the second fluid port during inward radial movement of the vane means;

(c) a core retaining barrel means axially attached to the rotor means and adapted to receive a core cutting head at an outer extremity such that cores cut from the sidewall of a drill hole can be retained within the core retaining barrel means;

(d) a bearing plate means operatively attached to the hydraulic motor housing and adapted to hydraulically seal around the core retaining barrel means axially attached to the rotor means thus sealing the rotor means within the rotor cavity;

(e) a guide groove means internal to the rotor cavity when sealed by the bearing plate means for guiding vane means occupying a substantially, radially oriented opening in the rotor means; and (f) a plurality of radially movable vane means each occupying one of the plurality of substantially radially oriented openings and adapted to move radially within the opening, wherein each radially movable vane means further comprises a guide means operatively engageable to the guide groove means to achieve radial movement.

It is an object of the present invention to provide an improved hydraulic motor for use in a sidewall coring tool. It is a further object to provide an improved hydraulic motor that produces a significant increase in mechanical torque and mechanical power output relative to previously known hydraulic motors for downhole oil and gas well applications. Fulfillment of these objects and the presence and fulfillment of additional objects will be apparent upon a complete reading of the specification and claims taken in conjunction with the attached drawings.

DESCRIPTION OF THE PREFERRED EMBODIMENTS

Figure 1:
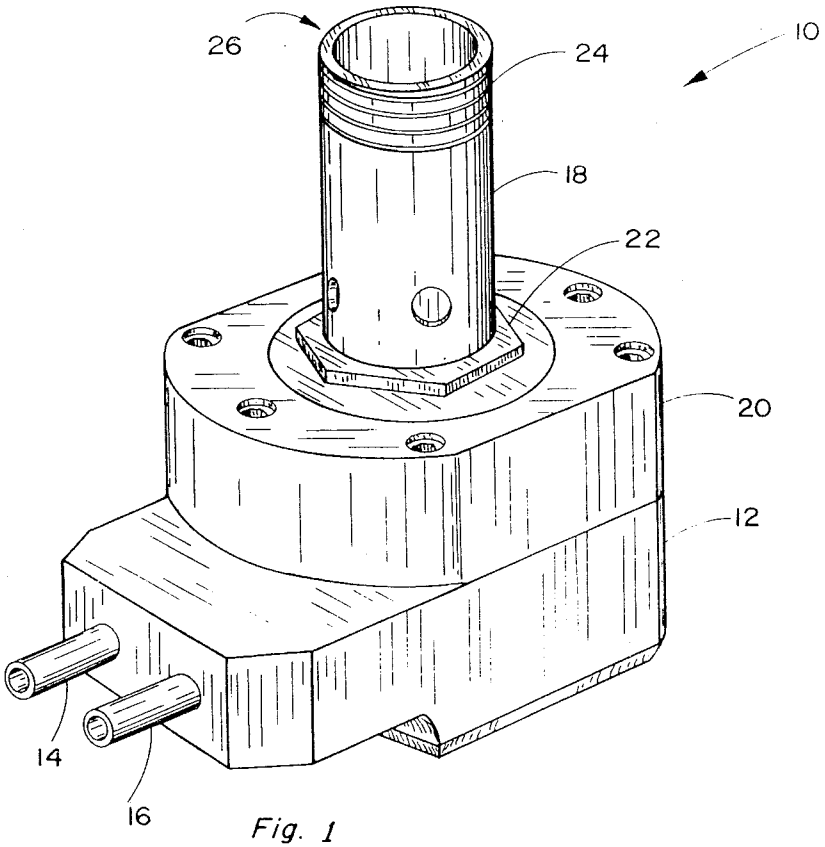
FIG. 1 is a perspective view of the improved downhole hydraulic according to the present invention.
Figure 4:
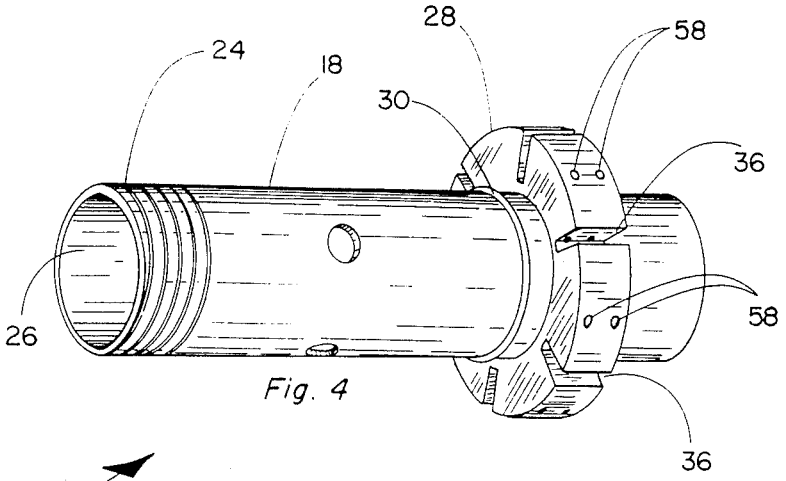
FIG. 4 a perspective view of the rotor and core retaining barrel of the improved hydraulic motor according to the present invention withdrawn from the motor housing.
Figure 2:
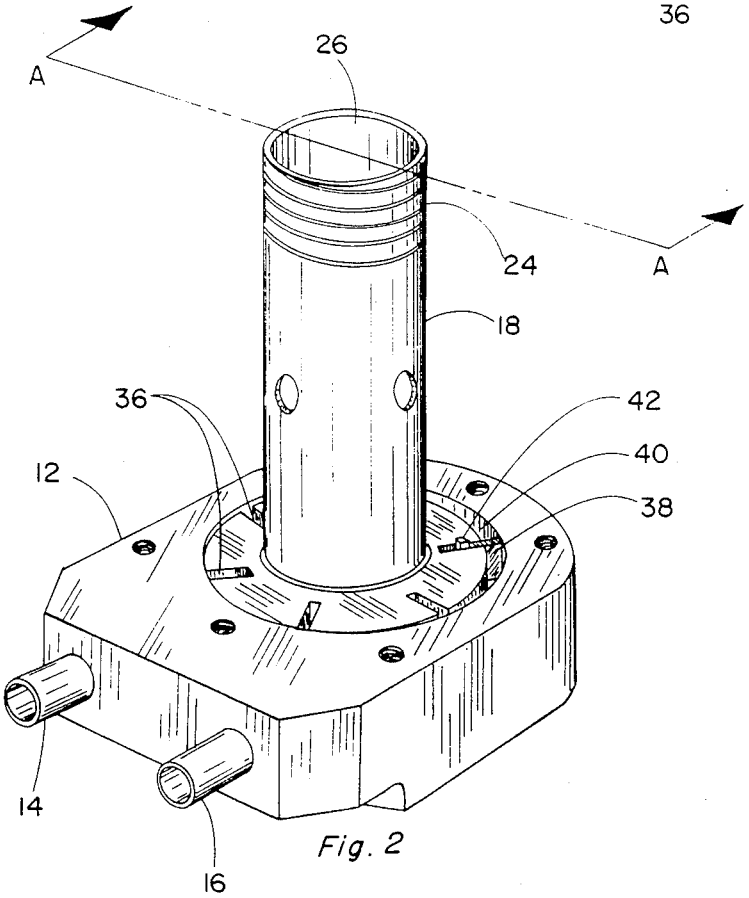
FIG. 2 is a perspective view of the improved downhole hydraulic motor of FIG. 1 with the bearing cap removed and some of rotor vanes withdrawn.

The improved hydraulic motor and how it differs from prior art hydraulic motors can perhaps be best explained and understood by reference to the drawings. As illustrated in FIG. 1, the overall hydraulic motor (generally designated by the numeral 10) involves a motor housing 12 with a pair of tubes 14 and 16 extending out of the housing 12. One of the tubes is the inlet and the other is the outlet for circulating high pressure hydraulic fluid through the motor such as to drive or spin the centrally located core barrel 18. As further illustrated in FIG. 1, the motor housing 12 has a bearing plate 20 with a threaded sealing nut 22 mounted to the top of the motor housing 12 compressively holding the motor together while hydraulically sealing the core barrel 18 that spins or revolves within the sealing nut 22. A similar sealing nut is provided on the underside of the motor housing 12 such as to allow the core barrel 18 to pass entirely through the rotor housing and rotor. Thus, as illustrated in FIG. 1, the external appearance of the improved hydraulic motor according to the present invention is very reminiscent of the hydraulic motor disclosed in U.S. Pat. No. 4,354,558 with the only significant differences for purposes of this invention occurring internally. As such, it should be appreciated that the improved hydraulic motor according to the present invention can be virtually substituted for the hydraulic motor as disclosed in U.S. Pat. No. 4,354,558 and used in a manner described therein. For more detailed explanation of how such a motor is to be incorporated into a sidewall coring tool and how such a tool is to be used, U.S. Pat. No. 4,354,558 is incorporated herein by reference for explanation purposes.

During operation, the core barrel 18 has a core cutting blade (not shown) attached to the threaded end 24 such that when the barrel 18 and cutting blade revolve, the rock cores cut from the sidewall of the well bore pass through the central opening 26 and are retrieved on the other side of the motor housing 12. As such, the sidewall coring tool can collect a series of core specimens at various depths during each trip into the well. However, because of this configuration and mode of operation, a serious physical limitation or physical criteria is imposed on the structure and design of the hydraulic motor that would not otherwise be present for other hydraulic motor applications. More specifically, the problems reduces down to designing a small compact hydraulic motor that can deliver sufficient mechanical torque and mechanical power in the confines of a well bore to cut rock cores from the sidewall and allow the rock cores to pass through the center of the rotor of the motor. In other words, the problem revolves around designing and engineering a rotor large enough to pass the core through the center, yet leave sufficient clearance for the motor housing and various motions necessary to cut the core from the sidewall and collect the cores, yet supply sufficient mechanical torque and mechanical power to accomplish the same. The improved hydraulic motor according to the present invention accomplishes this by providing an improved internal structure and fluid flow path that results in a signficant increase in mechanical torque and mechanical power relative to previously known hydraulic motors of the prior art.

As further illustrated in FIGS. 2 through 6, the core barrel or spindle 18 consists of a cylindrical hollow tube member that has a rotor 28 concentrically mounted around the barrel 18. The rotor 28 is positioned longitudinally on the barrel 18 by retaining rings and forced to revolve with the barrel by virtue of key 34 (see FIG. 5). Evenly spaced around the circumference of the rotor 28 is a plurality (six in the specific embodiment being illustrated) of radially oriented openings 36. Each opening is adapted to receive a radially movable vane or blade 38 which slides back and forth as the rotor revolves in a rotor cavity 40 of the motor housing 12. This sliding action is caused, in part, by the presence of ears 42 on the top and bottom of each vane 38 which serve as guide means by extending into and following grooves 44 and 46 and, in part, by fluid flow through fluid channels 58 located in the rotor, as explained in more detail later. Grooves 44 (see FIG. 3) and 46 (see FIG. 6) are located within the rotor cavity 40 with groove 44 machined into the motor housing 12 and groove 46 machined into the underside of the bearing plate 20, respectively. As illustrated, the grooves 44 and 46 are concentric relative to the rotor cavity 40 while the rotor 28 and core barrel 18 are off-set toward the side of the motor housing 12 having the hydraulic fluid tubes 14 and 16. Thus, the position of the axis of rotation of the rotor 28 relative to the rotor cavity 40 is such that the rotor is received eccentrically within the cavity with the displacement or eccentricity established between the axis of rotation of the rotor 28 and the center of the cavity 40 being directed toward the side of the rotor housing 28 having the fluid channels 14 and 16. In this manner, the fluid entering tube 14 is directed into cavity 40 in a substantially tangential relationship to the rotor cavity 40 and then is directed around the far side of the cavity opposite the eccentricity and exits through tube 16, again in a substantially tangential relationship to the rotor cavity 40, on the opposite side from the tube 14 and in an essentially parallel fluid channel but flowing in opposite directions to the fluid entering in inlet tube 14.

Figure 3:
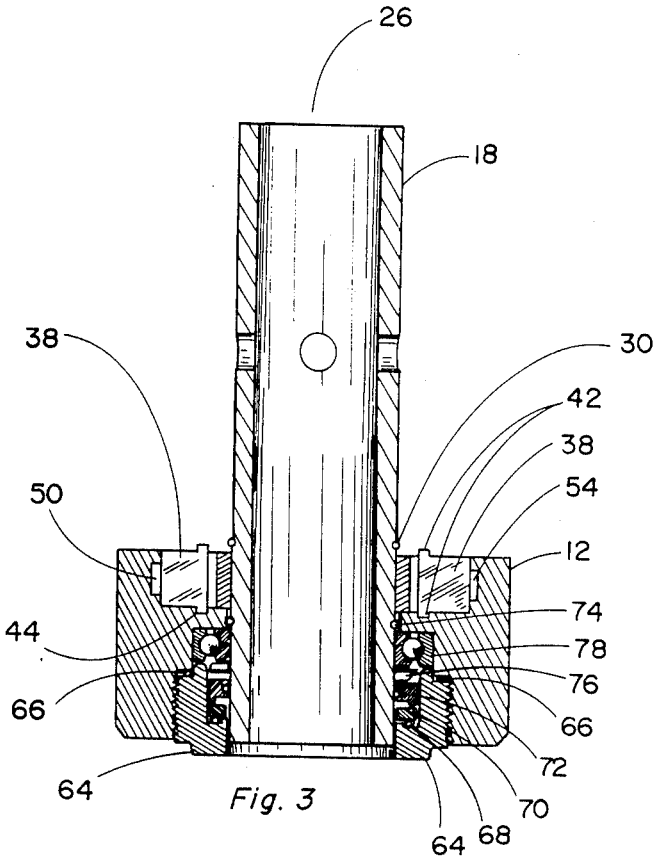
FIG 3 a cross-sectional view of the partially disassembled hydaulic motor of FIG. 2 as seen through line A—A.
Figure 5:
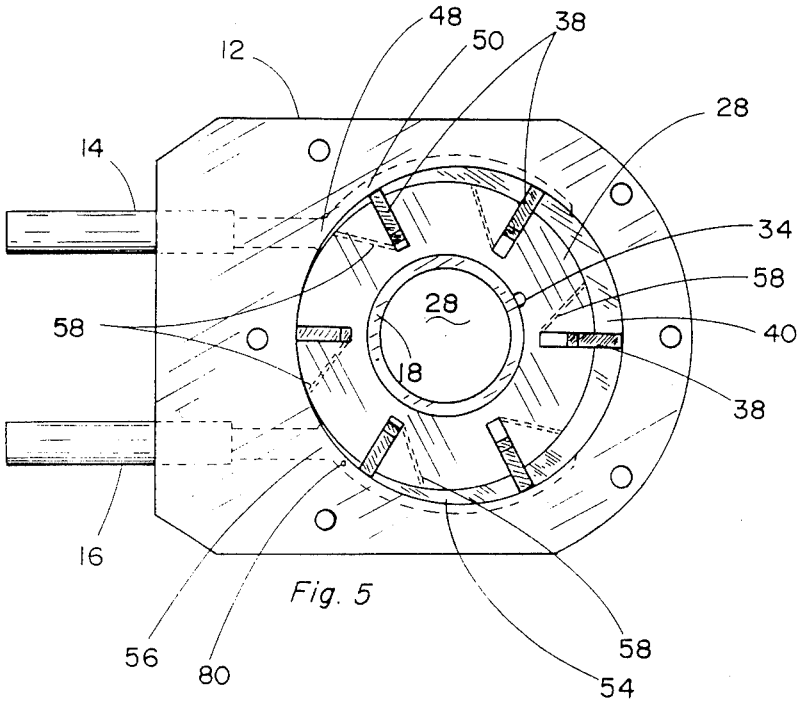
FIG. 5 a top elevational view of the partially disassembled hydraulic motor of FIG. 2 with the rotor vanes present.
Figure 6:
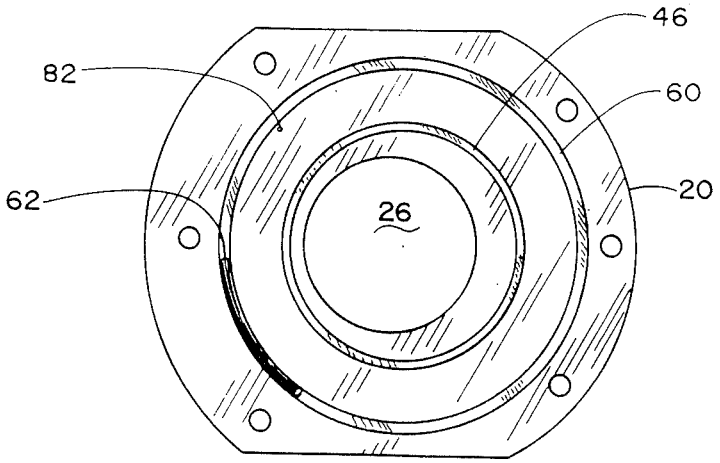
FIG. 6 is an underside view of the bearing cap of the improved hydraulics motor of FIG. 1 removed from the core retaining barrel and motor housing.

As further illustrated in FIGS. 3 and 5, the high pressure hydraulic fluid entering inlet tube 14 opens into the eccentric annulus created between the rotor 28 and the sidewall of cavity 40. Circumferentially located along the internal fluid port 48 of tube 14 is a recessed region 50 located along the inner periphery of the rotor cavity 40. This circumferential recess 50 extends along the inner sidewall of the cavity 40 to such an extent that the relatively high pressure fluid driving the motor and entering through tube 14 flows uniformly in the same direction as the rotor spins and makes high pressure contact with several vanes 38 simultaneously. Similarly, there is a second recessed region 54 extending along the inner wall of cavity 40 but on the other side of rotor 28 and in fluid communication with the exit port 56 associated with fluid exit tube 16. The second recess also extends along the inner sidewall of cavity 40 to such an extent that the relatively low pressure fluid associated with an outlet of the motor makes uniform contact with several other vanes 38 simultaneously as the fluid exits through port 56 and tube 16.

Between the first circumferential recess 50 and second circumferential recess 54 and to the far side of the cavity 40 (i.e., the region of maximum spacing between rotor 28 and the sidewall of cavity 40) is a region of maximum radial extension of the vanes 38. Within this region, the sliding action of the vanes 38 open and close confined pockets of fluid as the fluid is transferred from the high pressure inlet side to the relatively low pressure outlet side. As such, the pressure gradient at this region (more specifically, across this region) creates the force required to turn the motor while the geometry and configuration of flow through the circumferential recesses and associated annulus before and after this pressure drop region tend to optimize the force creating attributes of the fluid flow. On the near side of the cavity (i.e., the region of minimum clearance between rotor 28 and sidewall of cavity 40), the circumferential recesses are again not present and the vanes recede back into openings 36 as they move from outlet back to inlet as the rotor 28 spins.

To further improve the overall operation of the hydraulic motor, the internal portion of each radial opening 36 behind each vane or blade 38 is in fluid communication with the hydraulic fluid occupying the region that is pushing the vane. In other words, and as illustrated in FIG. 5, the rotor is rotating clockwise while the inner portion of the openings 36 are connected behind the vanes in that opening by small fluid channels 58 (in this specific embodiment being illustrated, two for each opening 36 and vane 38, see FIG. 4) which slope back counterclockwise relative to the vane. Furthermore, the clearance between the groove, 44 or 46, and the ears 42 on the vanes is intentionally established such that the final displacement of the vanes 38 towards the sidewalls of the cavity 40 is accomplished hydraulically by virtue of the presence of the fluid channel 58. Thus, as the vanes 38 sweep across the far side of the cavity, the fluid channel 58 experiences the high pressure of the inlet side of the motor which in turn, forces the vane 38 radially outward optimizing the seal between the vane and the cavity sidewall. Once the vane passes this region and makes contact with the second circumferential recess 54, the fluid channel 58 experiences the low pressure of the outlet of the motor. As the vane 38 recedes back into the opening 36, fluid flows out of the fluid channel 58 allowing the vane 38 and rotor 28 to spin past the near side of the cavity. Once past the near side, the fluid channel 58 is then exposed to the high pressure fluid of the inlet and the fluid flows back into the inner portion of opening 36 behind vanes 38 to start the cycle over. It is the composite of these fluid flow characteristics and their ultimate consequences of optimizing the net force exerted across the vanes of the rotor that is felt to be the critical distinguishing features of the present invention and the cause of the unexpected improvement in performance and efficiency of the improved motor according to the present invention.

As further illustrated in the drawings, the improved hydraulic motor is assembled such as to seal the rotor cavity 40. For example, the underside of the bearing plate 20 has an additional groove 60 concentric to groove 46 that contains an O-ring 62 therein that seats against the motor housing 12 when assembled. It should be appreciated that the motor could also be made by using a pair of bearing plates, one on either side of the motor housing, and still be within the contemplated scope of the invention. Such an embodiment would inherently involve an additional O-ring on the other bearing plate. Also, the bearing plate 20 and the motor housing 12 (alternatively the second bearing plate) hydraulically seal to the core barrel 18 such as to minimize leakage yet allow the core barrel 18 to spin. To achieve this sealing, the bearing plate 20 as well as the motor housing 12 are equipped with a sealing nut 22 and 64, respectively.

Figure 7:
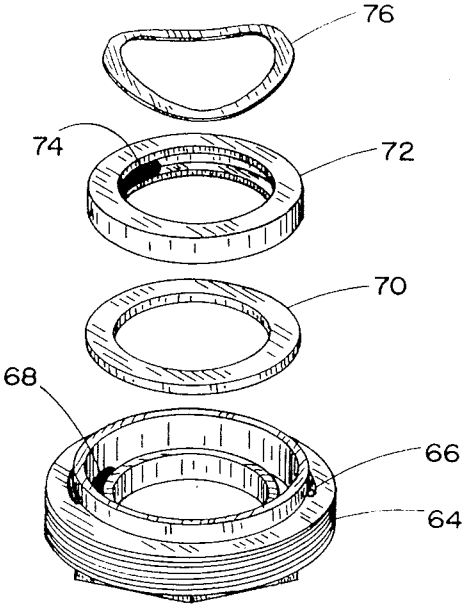
FIG. 7 an exploded view of the retaining rings and seals of the bearing plate and motor housing according to the present invention.

As illustrated in FIGS. 3 and 7, the sealing nut 64 (and sealing nut 22, not shown) is equipped with an O-ring 66 that seals to the motor housing 12, thus preventing fluid loss across the threads of the nut. A second O-ring 66 seals to a stationary washer 70 preventing fluid leakage behind the washer 70. The revolving washer 72 has an O-ring 74 that seals to the core barrel 18, preventing leakage along the barrel. Similarly o-ring 30 seals the core barrel to the central opening 26 in bearing plate 20. A compressive ring 76 resting on the inner race of bearing 78 and the revolving washer 72 forces the washers 70 and 72 into contact with each other, thus reducing leakage across the contacting surfaces. To further reduce leakage around the revolving core barrel 18, the internal regions associated with the components making up the bearing nut, bearing and seals of the barrel core are vented to the low pressure side or outlet of the motor. This is accomplished by small fluid channels 80 and 82 (see FIGS. 5 and 6) that intentionally pass through the circumferential outlet recess 54.

Figure 8:
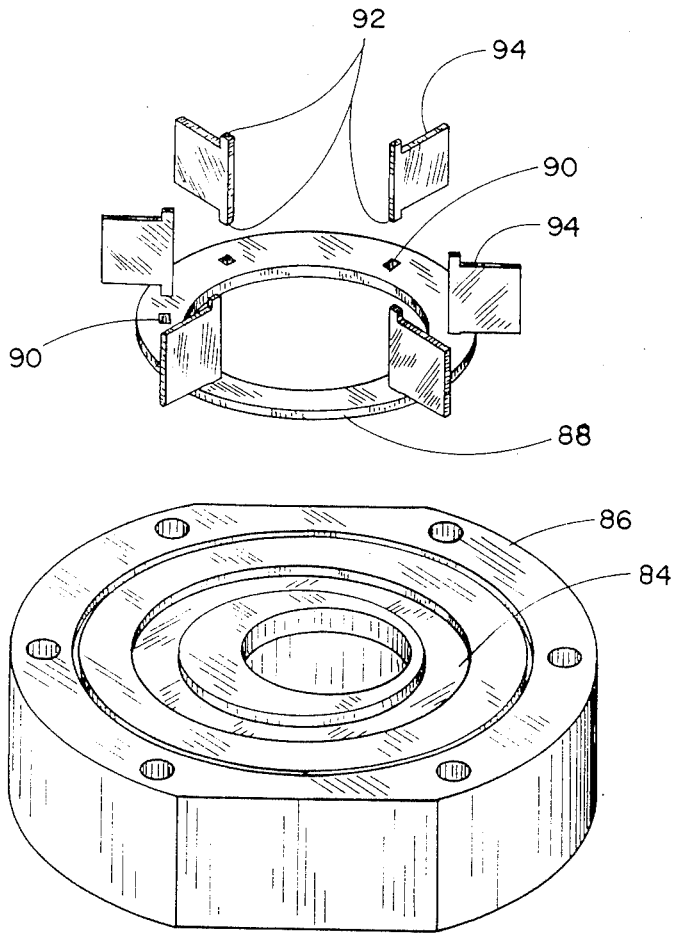
FIG. 8 illustrates the internal components of an alternate embodiment of the improved hydraulic motor according to the present invention.

FIG. 8 illustrates an alternate embodiment of the guide grooves within which the radially movable vanes with guide means (ears) travel. In this specific embodiment, the width of the guide grooves equivalent to the previous grooves 44 and 46 are enlarged and a guide washer or guide ring with openings to accept the ears on the vanes or blades is placed within the guide grooves. For example, and as illustrated in FIG. 8, the groove 84 in the bearing plate 86 (also the groove in the motor housing, not shown) is occupied by a guide ring 88. This guide ring 88 has a plurality of openings 90 into which the ears 92 of the vanes 94 insert. As such, the guide ring 88 revolves with the vanes, rotor and core barrel and also occupies the space associated with the groove. This in turn reduces the tendency for internal leakage along the groove and improves the overall efficiency of the hydraulic motor. It should be appreciated that the width of the groove and guide ring can be varied even to the extent of creating a closed impeller type assembly, particularly in the alternate embodiment involving a pair of bearing plates wherein the outer circumference of the guide ring would encompass the maximum radial extension of the vanes.

Having thus described the invention with a certain degree of particularity, it is manifest that many changes can be made in the details of the invention without departing from the spirit and scope of the invention. Therefore, it is to be understood that the invention is not limited to the embodiments set forth herein for purposes of exemplification, but is to be limited only by the scope of the attached claims, including a full range of equivalents to which each element thereof is entitled.

We claim:

1. In an apparatus for drilling core cutting from the sidewall of a drill hole wherein the apparatus comprises an elongated housing with a hydraulic operated back-up shoe mounted within the housing for wedging the housing at a selected location in the drill hole and a hydraulic motor with a drilling bit connected thereto for rotation by the hydraulic motor and hydraulic means mounted within the housing and connected to the hydraulic motor for moving the bit into drilling engagement with the sidewall of the drill hole, (a) A hydraulic motor housing member containing a rotor cavity adapted to eccentrically receive a rotor means therein and further adapted to drive a rotor means be virute of fluid flow, wherein said hydraulic motor housing member further comprises:

(i) a first fluid channel passing from the outside of said hydraulic motor housing member to said rotor cavity in a substantially tangential relationship to said rotor cavity and terminating at a first position of intersection with said rotor cavity as a first fluid port, (ii) a second fluid channel passing from the outside of said hydraulic motor housing member to said rotor cavity in a substantially parallel relationship with said first fluid channel and in a substantially tangential relationship to said rotor cavity and terminating at a second position of intersection with said rotor cavity as a second fluid port on the side of said rotor cavity substantially opposite to said first fluid port, (iii) a pair of recesses circumferentially located on a portion of the inner periphery of said rotor cavity nearest and first and second fluid ports, wherein one of said recesses inersects and first fluid port only and the other of said recesses intersects and second fluid port only and each extends circumferentially on either side of said fluid ports but do not extend substantially along those portions of the inner periphery of said rotor cavity nearest to and furthest from the axis of rotation of the rotor means, such that fluid entering said first fluid channel is directed circumferentially, in said tangential direction of approach, around said rotor cavity to the far side of an eccentrically positioned rotor means and then exits said second fluid channel;

(b) a rotor means adapted to be received eccentrically within said rotor cavity of said hydraulic motor housing and be driven by fluid entering said first fluid channel and exiting said second fluid channel, wherein said rotor means further comprises a plurality of substantially, radially oriented openings each adapted to receive a radially movable vane means therein and wherein each of said plurality of substantially, radially oriented openings have at least one fluid conduit in fluid communication with the innermost portion of substantially, radially oriented opening and adapted to establish fluif communication with said pair of recesses circumferentially located on a portion of the inner periphery of said rotor cavity during rotation of said rotor means and wherein said fluid conduit is positioned in a manner such as to establish fluid comunication behind a radially movable vane means occupying said substantially, radially oriented opening and said pair of recesses by directing relatively high pressure fluid flow into said opening and behind said vane means from said recess that intersects said first fluid port during outward radial movement of said vane means and by directing fluid flow from said opening and behind said van means to a relatively low pressure fluid in said recess that intersects said second fluid port during inward radial movement of said vane means each said vane means having, at its inner end, guid ears extending above and below said vane, (c) a core retaining barrel means axially attached to said rotor means and adapted to receive a core cutting head at an outer extremity such that cores cut from the sidewall of a drill hole can be retained within said core retaining barrel means;

(d) a bearing plate means operatively attached to said hydraulic motor housing and adapted to hydraulically seal around said core retaining barrel means axially attached to said rotor means thus sealing the rotor means within said rotor cavity;

the improvement comprising:

(e) a guide groove of given depth and width in said hydraulic motor housing member on one side of said rotor means and a guide groove of the same said given depth and width in said bearing plate means on the other side of said rotor means, said guide grooves being concentric relative to said rotor cavity; and (f) a guide ring for each of said guide grooves each said guide ring being of substantially the same said given depth and width so as to rotate in said guide grooves, a plurality of circumferentially spaced openings in said guide rings to receive said guide ears.

* * * * *